US008387283B2

(12) United States Patent
Petzl et al.

(10) Patent No.: US 8,387,283 B2
(45) Date of Patent: Mar. 5, 2013

(54) ICE CRAMPON FOR MOUNTAINEERING WITH ADJUSTABLE FRONT SPIKE

(75) Inventors: Paul Petzl, Barraux (FR); Pierre Plaze, Chambery (FR)

(73) Assignee: Zedel, Crolles (FR)

( * ) Notice: Subject to any disclaimer, the term of this patent is extended or adjusted under 35 U.S.C. 154(b) by 675 days.

(21) Appl. No.: 12/585,434

(22) Filed: Sep. 15, 2009

(65) Prior Publication Data

US 2010/0064552 A1 Mar. 18, 2010

(30) Foreign Application Priority Data

Sep. 15, 2008 (FR) ..... 08 05046

(51) Int. Cl.
*A43C 15/06* (2006.01)
*A43C 15/14* (2006.01)

(52) U.S. Cl. ..... 36/59 R; 36/61; 36/124

(58) Field of Classification Search ..... 36/7.6, 36/7.7, 59 R, 61, 62, 124
See application file for complete search history.

(56) References Cited

U.S. PATENT DOCUMENTS

| | | | | |
|---|---|---|---|---|
| 4,480,396 | A | 11/1984 | Lowe et al. | |
| 4,910,883 | A | 3/1990 | Zock, Jr. | |
| 6,766,597 | B1 | 7/2004 | Perrod et al. | |
| 6,966,127 | B2 * | 11/2005 | Petzl et al. | 36/7.6 |
| 7,003,901 | B2 * | 2/2006 | Petzl et al. | 36/7.6 |
| 7,089,688 | B2 * | 8/2006 | Giovale | 36/7.6 |
| 2002/0178611 | A1 * | 12/2002 | Farys | 36/7.6 |

FOREIGN PATENT DOCUMENTS

| | | | |
|---|---|---|---|
| EP | 0 233 130 | A1 | 8/1987 |
| EP | 1 348 350 | A1 | 10/2003 |
| FR | 1 330 099 | A | 6/1963 |
| FR | 2 587 223 | A1 | 3/1987 |

* cited by examiner

*Primary Examiner* — Khoa Huynh
*Assistant Examiner* — Sharon M Prange
(74) *Attorney, Agent, or Firm* — Oliff & Berridge, PLC

(57) ABSTRACT

An ice crampon including a metal armature, the metal armature being composed of a horizontal support plate, at least one front spike in the form of a blade, and an adjustment device for adjusting the length of said front spike between a withdrawn position and an advanced position. In the intermediate part, each front spike comprises two circular apertures for passage of a fixing screw in both the withdrawn and advanced positions, and in the rear part comprises a sliding link operating in conjunction with a positioning cross-member securely attached to the armature when adjustment is performed. The sliding travel corresponds to the longitudinal distance between the two apertures, and the positioning cross-member is notched over its whole width with a succession of rectangular notches and indentations further enabling transverse positioning of the front spike.

6 Claims, 16 Drawing Sheets

ICE CRAMPON FOR MOUNTAINEERING WITH ADJUSTABLE FRONT SPIKE

BACKGROUND OF THE INVENTION

The invention relates to an ice crampon comprising a metal armature composed of:

- a horizontal support plate equipped with vertical anchoring spikes,
- at least one front spike in the form of a blade salient from the front part of the armature,
- and means for adjusting the length of said front spike between a withdrawn position and an advanced position.

STATE OF THE ART

For climbing on ice cascades, it is known to modify the adjustment of the front spikes of the armature of a crampon according to the state of the ice which can vary quickly according to weather conditions and the outside temperature. The front spikes generally comprise a plurality of holes for adjusting the length and/or tilt. Hard pack-ice at very low temperature does not have to be attacked in the same way as ice that is more tender and more friable at a higher temperature. The final assembly requires two fixing screws passing through two selected holes to obtain efficient securing. The two fixing screws have to be removed and refitted to modify the adjustment of the front spikes, which imposes a certain handling and adjustment time. Such a device is described in the document FR 2587223.

OBJECT OF THE INVENTION

The object of the invention consists in providing an ice crampon for mountaineering enabling the longitudinal and/or transverse positioning of at least one front spike to be adjusted easily and quickly.

The crampon according to the invention is characterized in that the adjustment means comprise two apertures arranged in the intermediate part of said front spike for passage of a fixing screw in both the withdrawn and advanced positions, and a sliding link operating in conjunction with a positioning cross-member securedly attached to the armature, the sliding travel corresponding to the longitudinal distance between the two apertures.

The positioning cross-member extends in a direction parallel to the fixing screw and is arranged such as to enable one or two front spikes to be fitted with a predefined longitudinal and transverse positioning. A single fixing screw is required to perform adjustment.

According to a preferred embodiment, the positioning cross-member is notched over its whole width with a succession of rectangular notches and indentations arranged symmetrically on the two opposite sides. The rear groove of the front spike presents a T-shaped profile with a straight bottom extending in a direction parallel to the longitudinal offset of the two apertures. The front spike is arranged in a predefined indentation of the cross-member and is securedly blocked in the transverse direction by the adjacent notches in both the withdrawn and advanced positions.

BRIEF DESCRIPTION OF THE DRAWINGS

Other advantages and features will become more clearly apparent from the following description of particular embodiments of the invention given as a non-restrictive example only and represented in the accompanying drawings, in which.

DESCRIPTION OF PARTICULAR EMBODIMENTS

Figure 1:
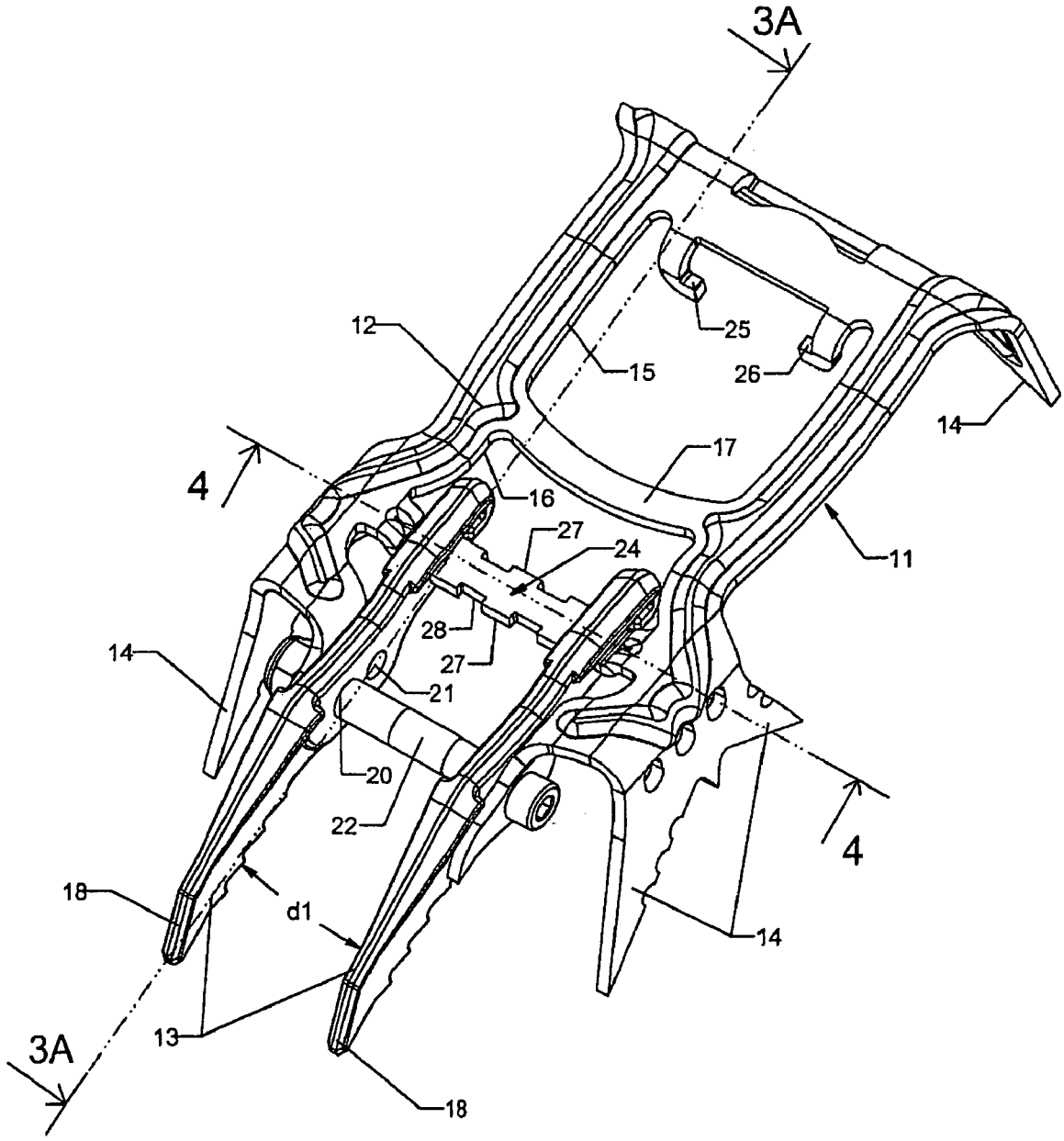
FIG. 1 is a schematic perspective view of the front clamp of a crampon according to the invention equipped with a pair of front spikes represented in the withdrawn position.

With reference to FIGS. 1 to 4, the front clamp 10 of an ice crampon comprises a metal armature 11 made from tempered steel composed of a support plate 12 designed to be fixed under the sole of the shoe, and a pair of front spikes 13. The rear clamp and the connecting bar are not represented in the figures and are known as such according to the document EP1348350.

Armature 11 is manufactured by cutting and folding a steel strip followed by thermal hardening to obtain the required hardness. Front spikes 13 have identical structures formed by steel blades fixed to the front part of armature 11 and extending in two parallel vertical planes.

The horizontal surface of sole 12 is provided with openings 15, 16 separated from one another by a transverse spacer plate 17. The periphery of armature 11 is further provided with a series of vertical spikes 14 extending downwards on each side. For example purposes, the two vertical spikes 14 situated on each side of armature 11 at the level of cross-member 24 are arranged in a reverse V-shape, one to the front and the other to the rear.

The front part of each front spike 13 comprises a peak 18 in the form of a saw-tooth extended along the bottom edge by a series of anchoring teeth 19. The intermediate part of each front spike 13 is provided with two circular apertures 20, 21 staggered in the longitudinal direction and allowing passage of a fixing screw 22 when adjustment of front spikes 13 in two positions is performed. The two front sides of armature 11 are provided with a pair of holes designed to be aligned with one of the apertures 20, 21 of each front spike 13 for passage of fixing screw 22.

The rear part of each front spike 13 is equipped with a semi-open groove 23 having a T-shaped profile with a straight bottom constituting a sliding link able to slide on a positioning cross-member 24 to perform said adjustment.

The depth of groove 23 is slightly larger than the thickness of cross-member 24 to enable the adjustment movement. Cross-member 24 extends in a parallel direction to fixing screw 22 delineating opening 16 with spacer plate 17. The rear of armature 11 is provided with two curved lugs 25,26 designed for fitting the connecting bar (not shown).

Positioning cross-member 24 is formed by a small bar notched over its whole length and presenting on the two lateral sides a succession of rectangular-shaped notches 27 and indentations 28 arranged symmetrically with respect to the transverse direction.

Figure 3A:
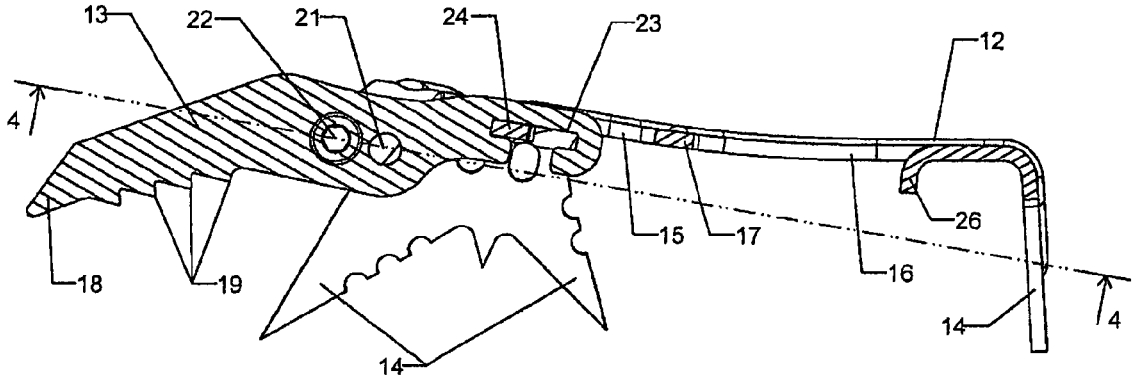
FIGS. 3A and 3B are longitudinal cross-sectional views along the respective lines 3A-3A and 3B-3B of FIGS. 1 and 2.
Figure 3B:
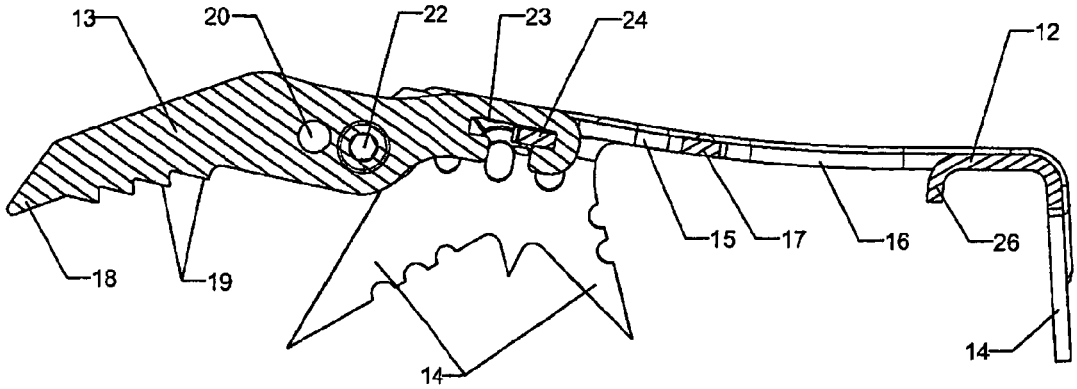
Figure 4:
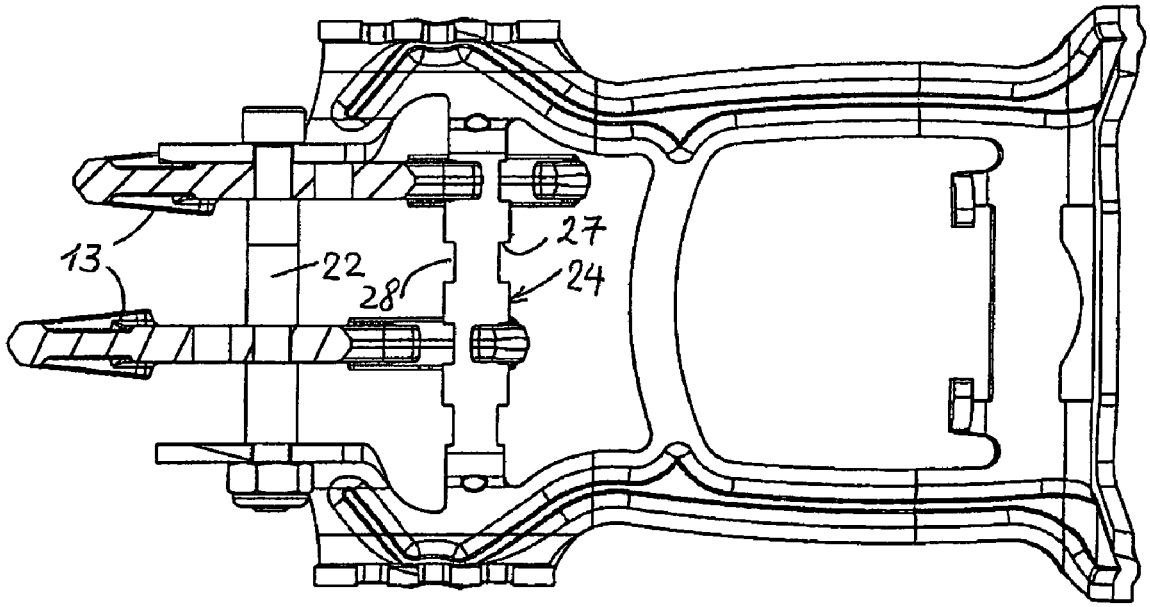
FIG. 4 shows a transverse cross-sectional view along the line 4-4 of FIG. 1.

Adjustment of the length and secure fastening of each front spike 13 are performed in the following manner using a single fixing screw 22:

In FIGS. 1, 3A and 4, each front spike 13 is located in a withdrawn position with fixing screw 22 passing through the apertures 20 aligned with the holes of armature 11. The left flank of groove 23 of each front spike 13 is abutting the stop formed by cross-member 24 to perform securing in the longitudinal direction. Lateral positioning of the front spikes 13 is also performed in this position by means of the adjacent notches 27 which hold them in the corresponding indentations 28. Longitudinal and lateral securing of the front spikes 13 is thereby achieved by means of a single fixing screw 22. The two front spikes 13 are immobilized in the withdrawn position, being parallel and separated from one another by a maximum gap d1. Gap d1 is smaller than the distance separating the two vertical spikes 14 on each side of armature 11.

Figure 2:
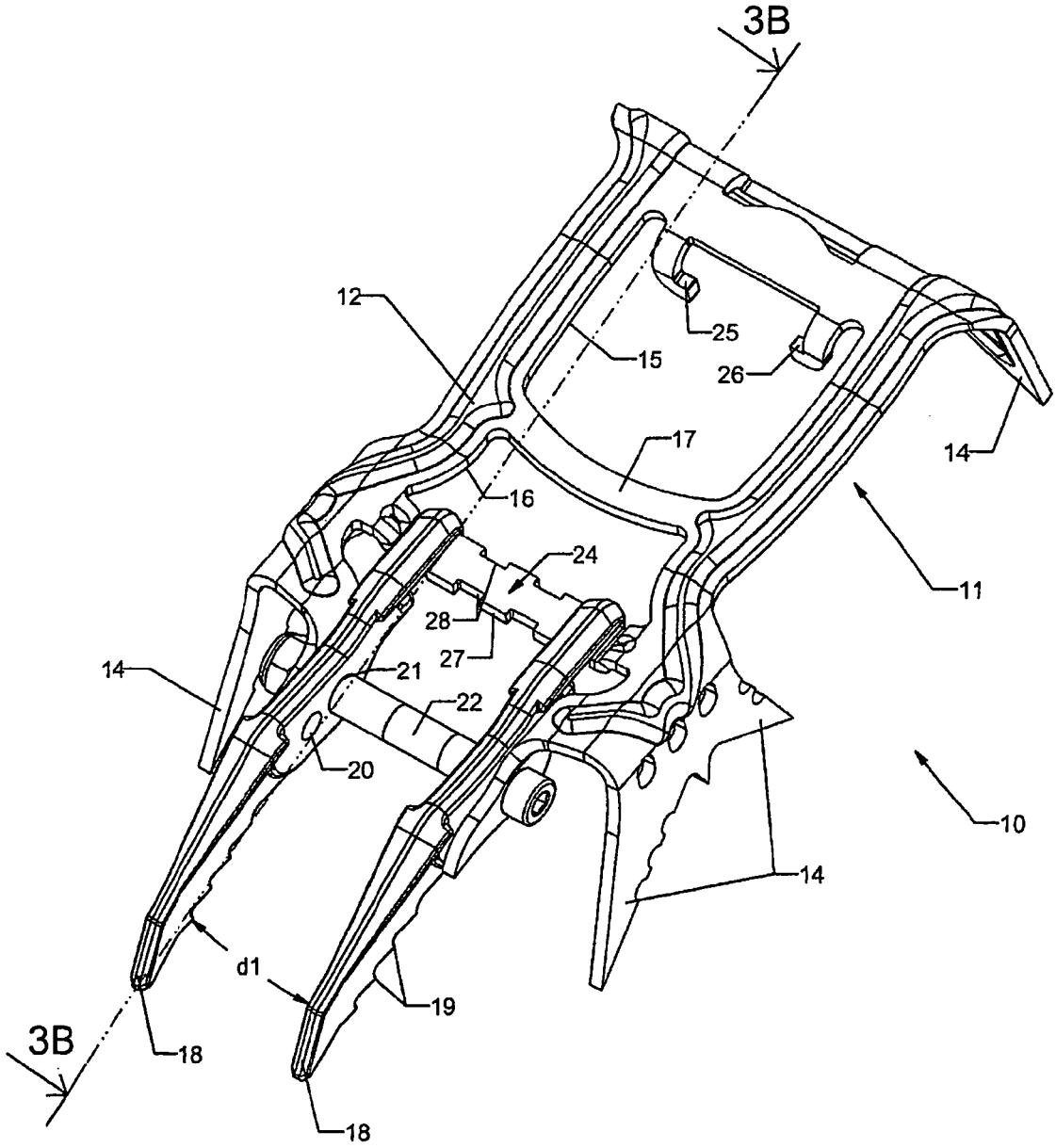
FIG. 2 is an identical view to FIG. 1 with the two front spikes in the advanced position.

To modify the longitudinal adjustment of front spikes 13, fixing screw 22 simply has to be untightened and removed, and front spikes 13 then be slid to the advanced position (FIG. 3B) in which the right flank of groove 23 comes up against the stop formed by the opposite edge of cross-member 24. Apertures 21 of front spikes 13 are then aligned with the holes of armature 11 allowing fixing screw 22 to pass (FIG. 2). The two front spikes 13 are immobilized in the advanced position, remaining parallel and separated from one another by the same transverse gap d1.

Figure 5:
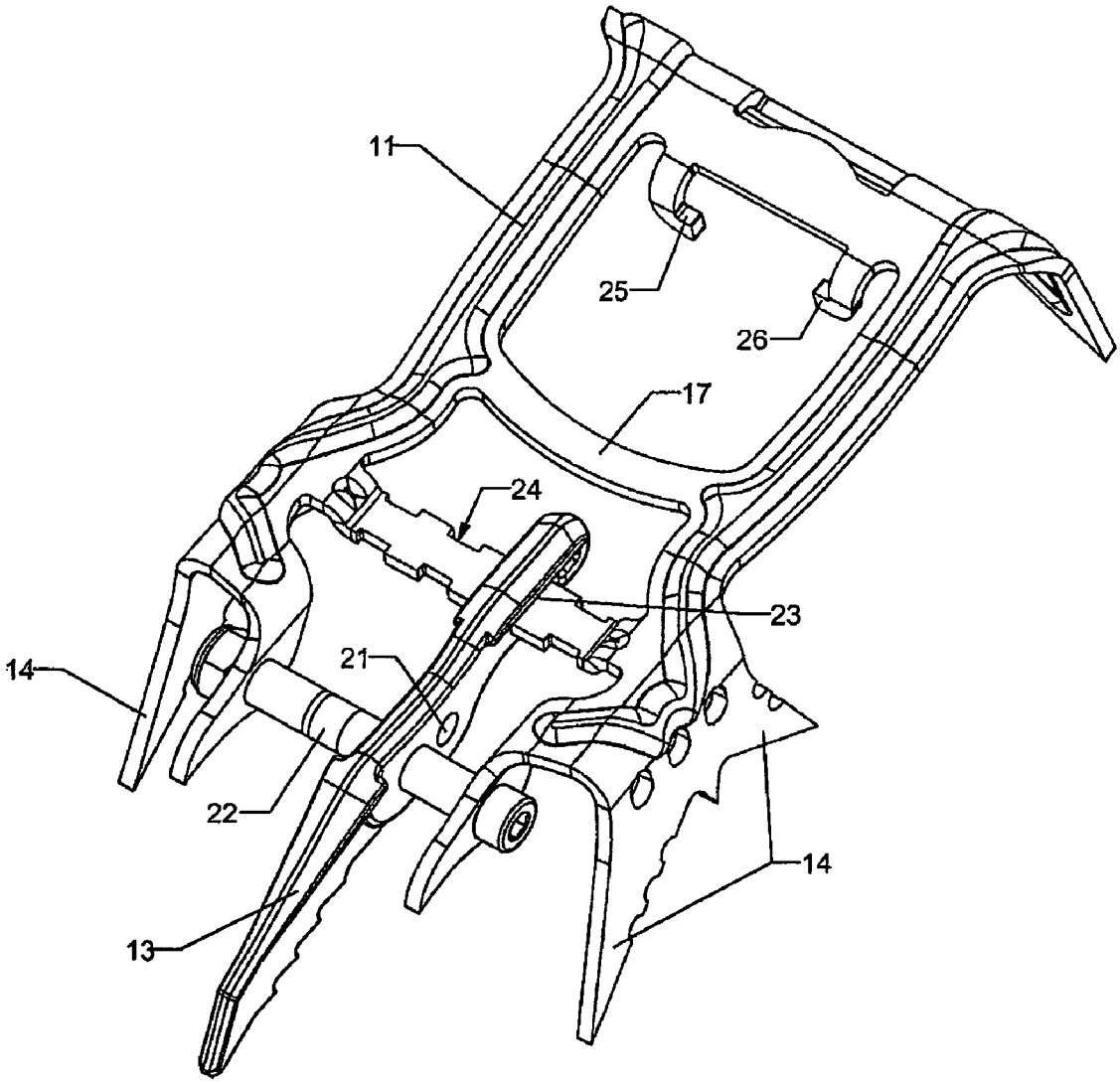
FIGS. 5 and 6 are alternative embodiments of FIGS. 1 and 2 with a single front spike respectively in the withdrawn position and in the advanced position.
Figure 6:
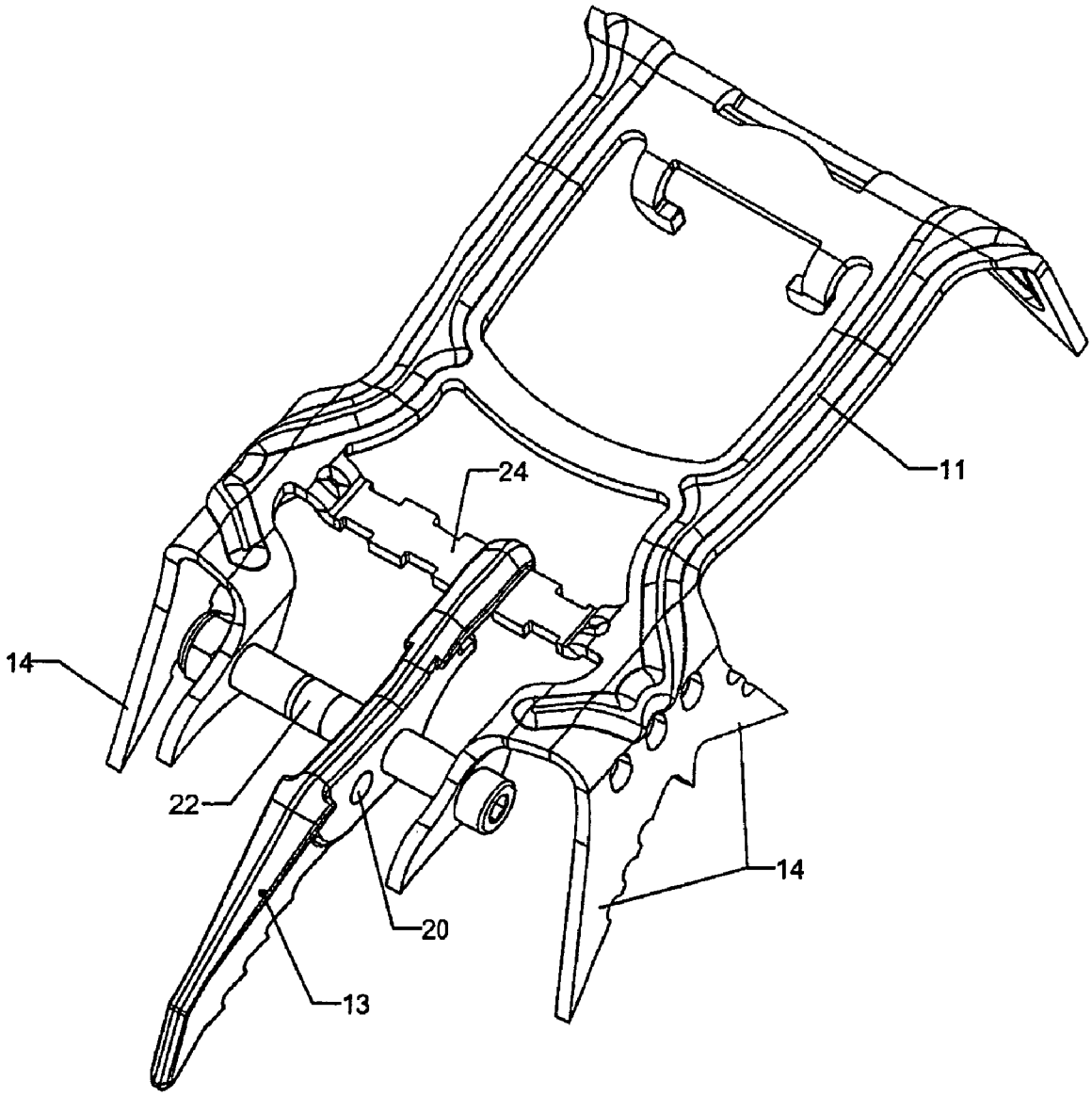

In FIGS. 5 and 6, a single front spike 13 can be used the corresponding groove 23 whereof is placed in a predefined indentation 28 of cross-member 24. The other front spike 13 has been removed after first removing fixing screw 22 and lifting the rear part to make cross-member 24 come out of groove 23. The lateral positioning of the single blade depends on the indentation 28 selected on cross-member 24.

In the example of FIG. 5, the lateral positioning of front spike 13 is dissymmetric with respect to the longitudinal mid-plane and advantageously corresponds to a crampon that will be fitted to the user's right shoe. In the longitudinal direction, the single blade is located in the withdrawn position as in FIG. 1.

In FIG. 6, the single blade is located in the advanced position as in FIG. 2. The lateral positioning of front spike 13 corresponds to that of FIG. 5.

Figure 7:
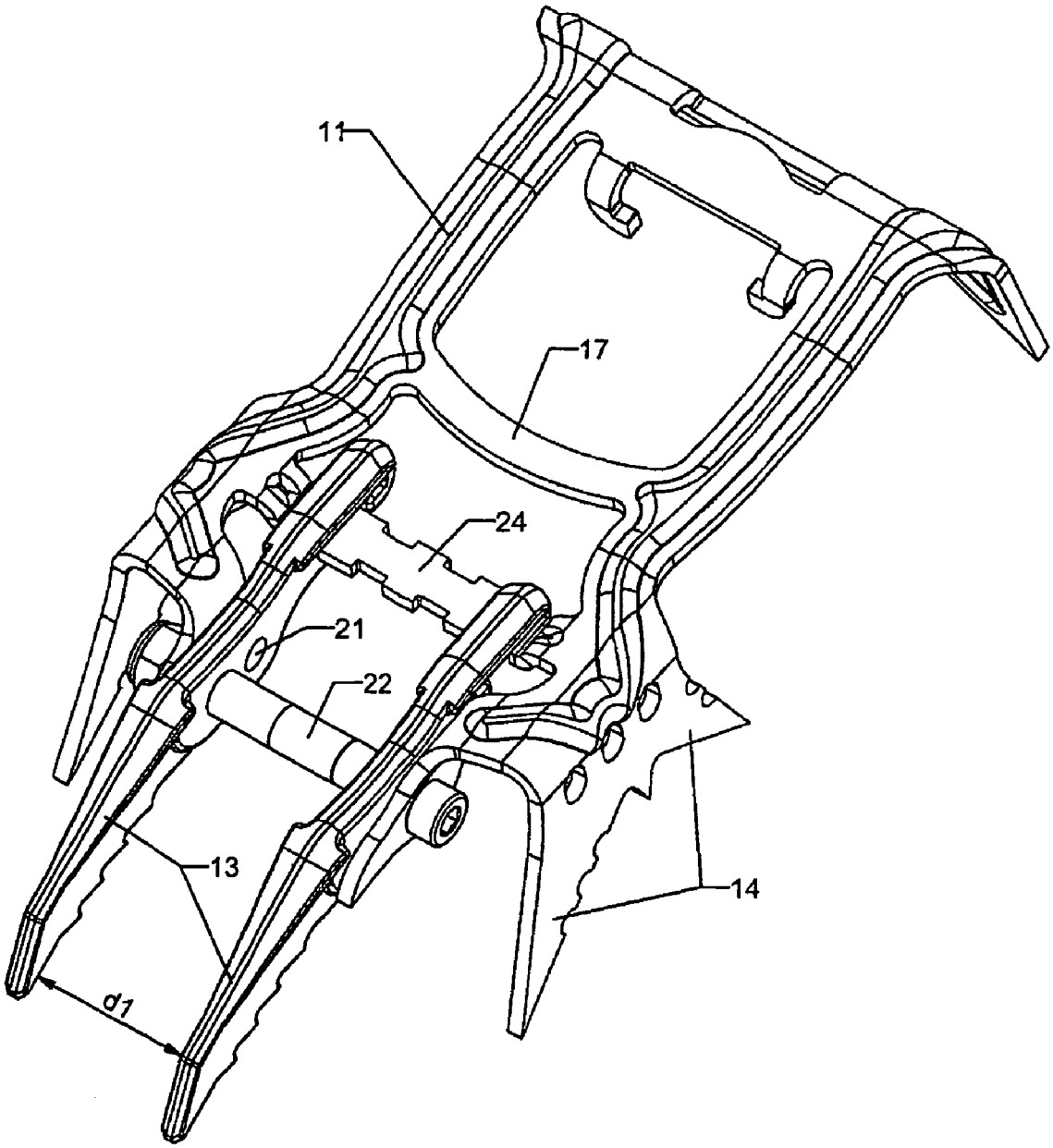
FIGS. 7 and 8 are alternative embodiments of FIGS. 1 and 2 with a different longitudinal and transverse positioning of a pair of front spikes.
Figure 8:
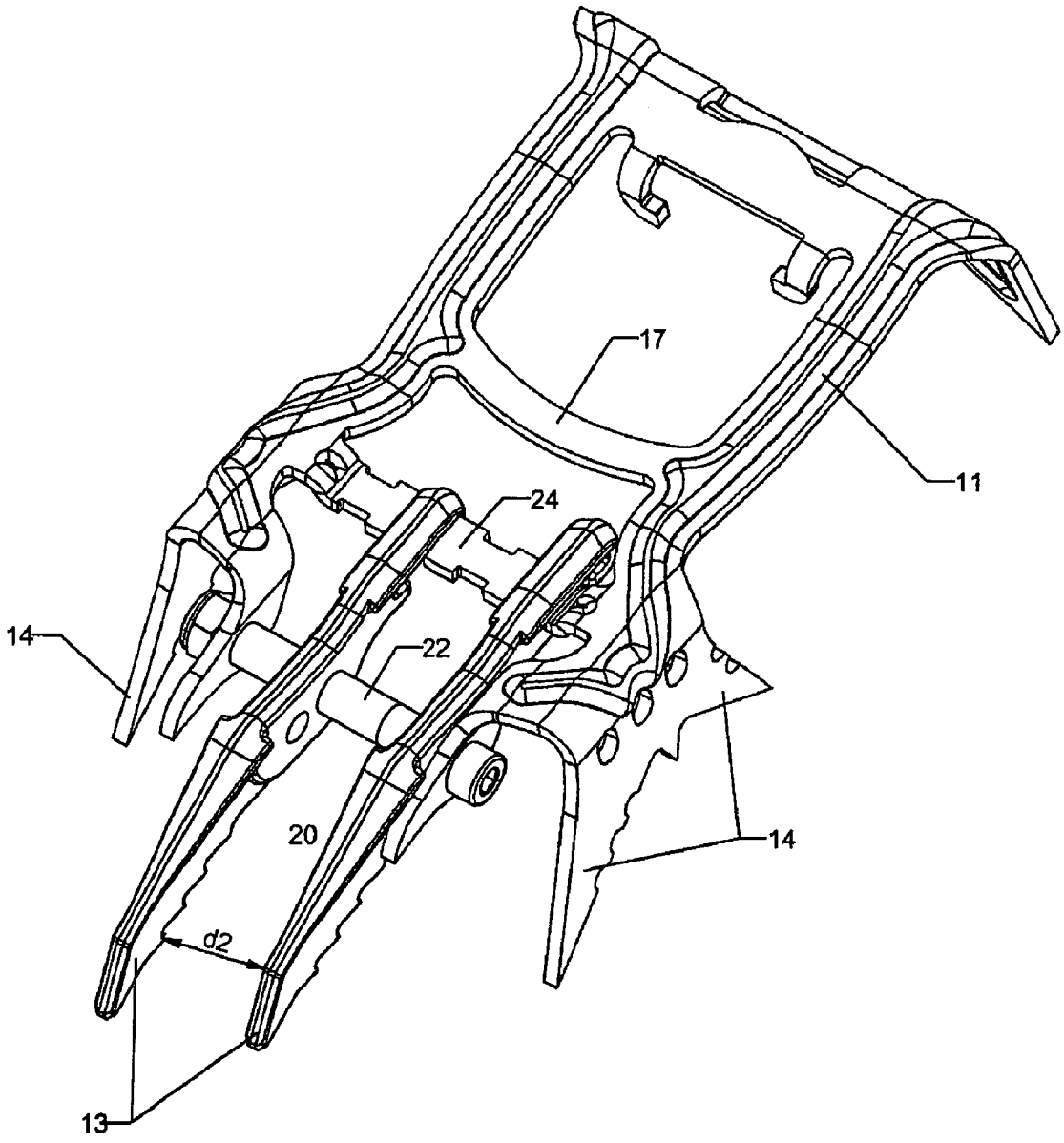

With reference to FIGS. 7 and 8, two front spikes 13 are used with a dissymmetric longitudinal positioning and a different lateral positioning.

In FIG. 7, left-hand front spike 13 is in the withdrawn position whereas right-hand front spike 13 is in the advanced position. The two front spikes 13 are housed in the end indentations 28 of cross-member 24, which corresponds to a separation gap d1, like that of FIGS. 1 and 2.

In FIG. 8, left-hand front spike 13 is in the advanced position whereas right-hand front spike 13 is in the withdrawn position. Left-hand front spike 13 is housed in an intermediate indentation 28 of cross-member 24, which corresponds to a separation gap d2, smaller than that of d1.

Figure 9:
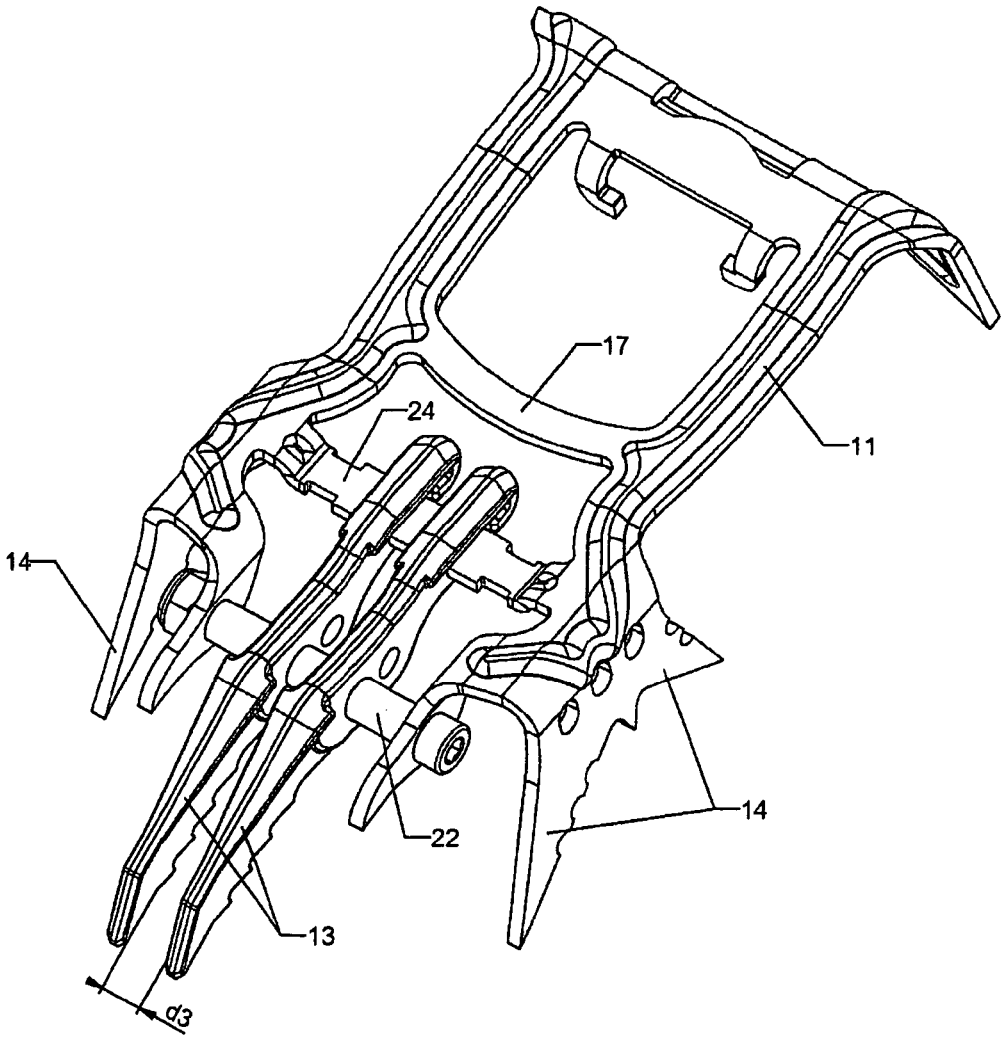
FIGS. 9 and 10 represent alternative embodiments of FIGS. 1 and 2 with another longitudinal and transverse positioning of the front spikes.
Figure 10:
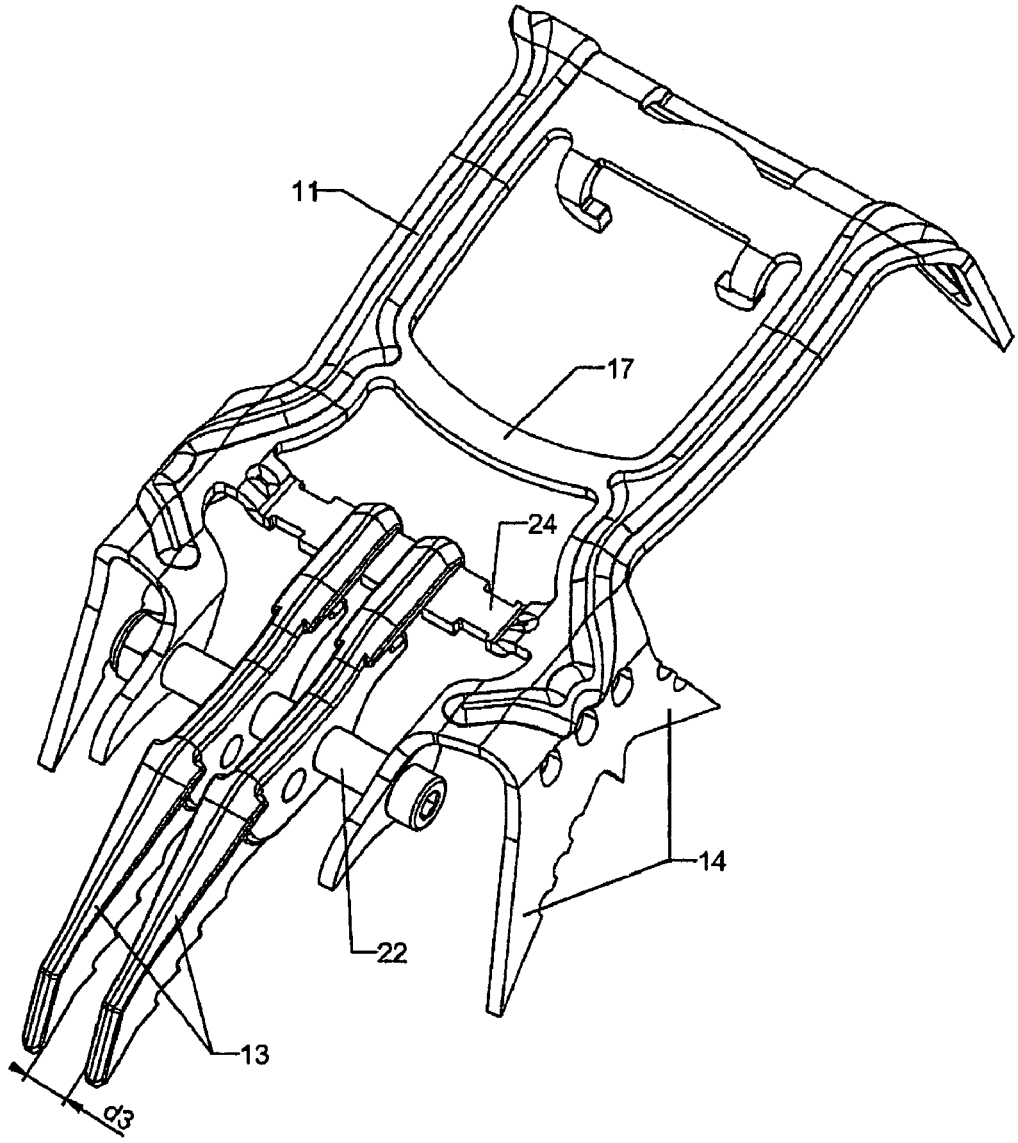
Figure 11:
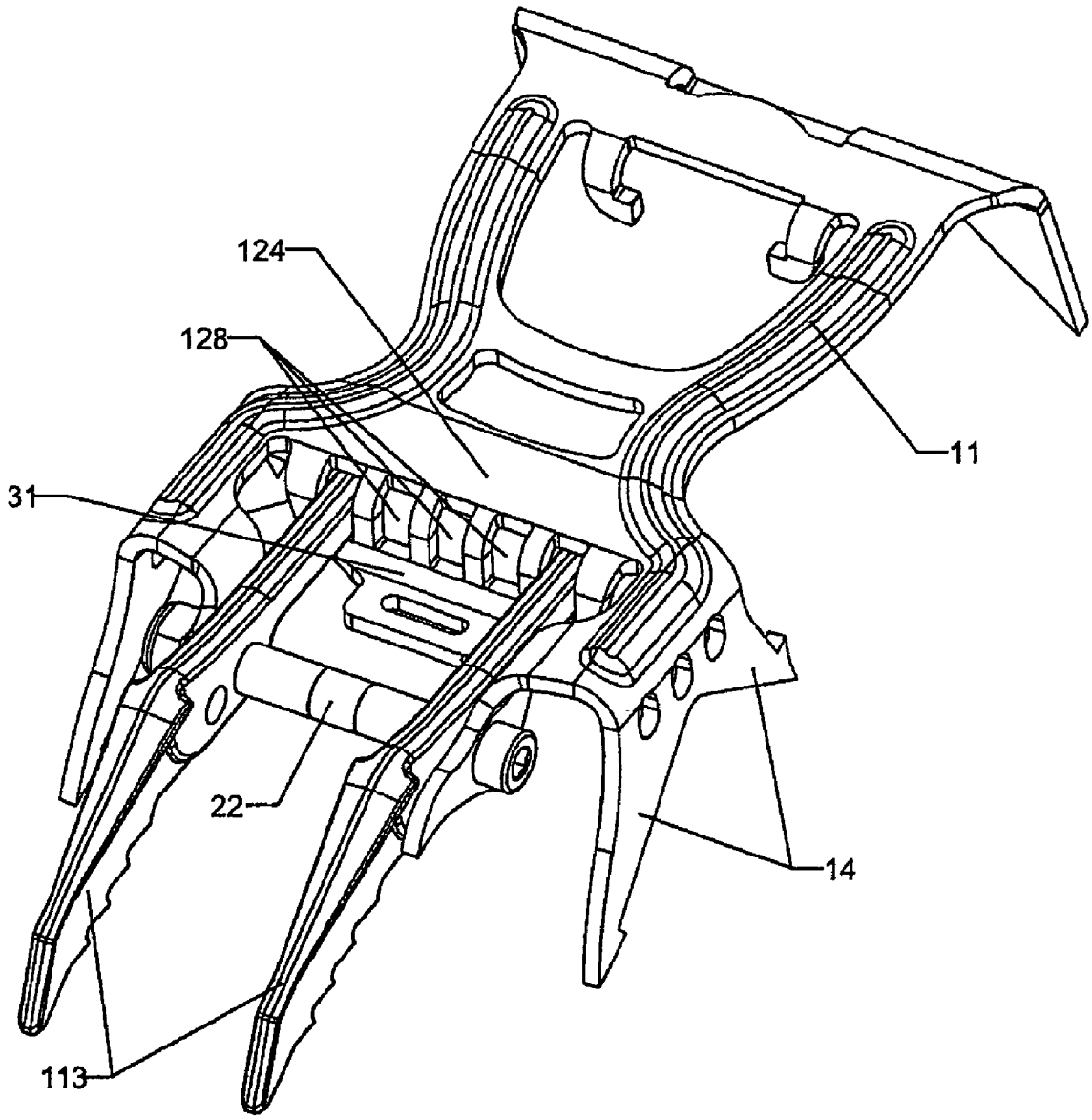
FIG. 11 is a schematic perspective view of an alternative embodiment of the front clamp according to the invention which is equipped with a pair of front spikes in the advanced position.
Figure 12:
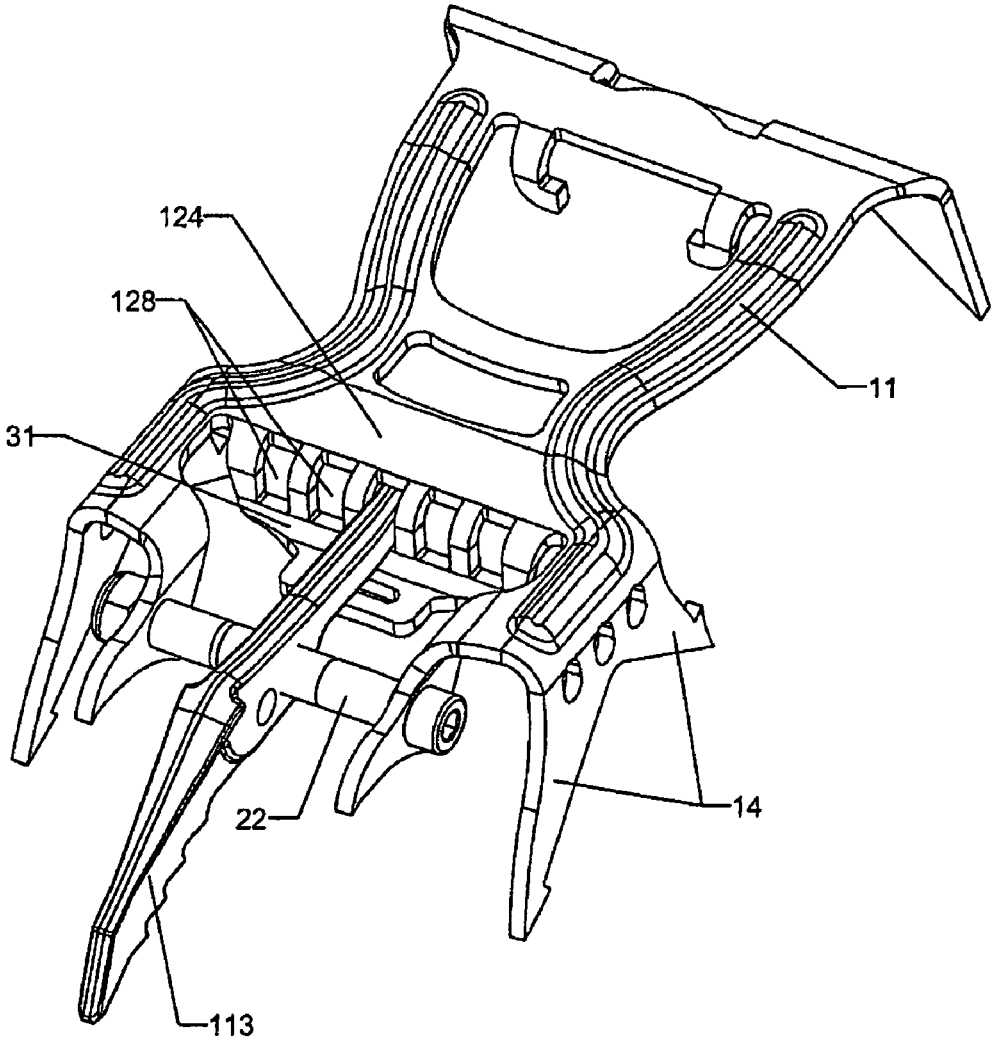
FIG. 12 is an identical view to FIG. 11 with a single front spike in the advanced position in the middle of the armature.
Figure 13A:
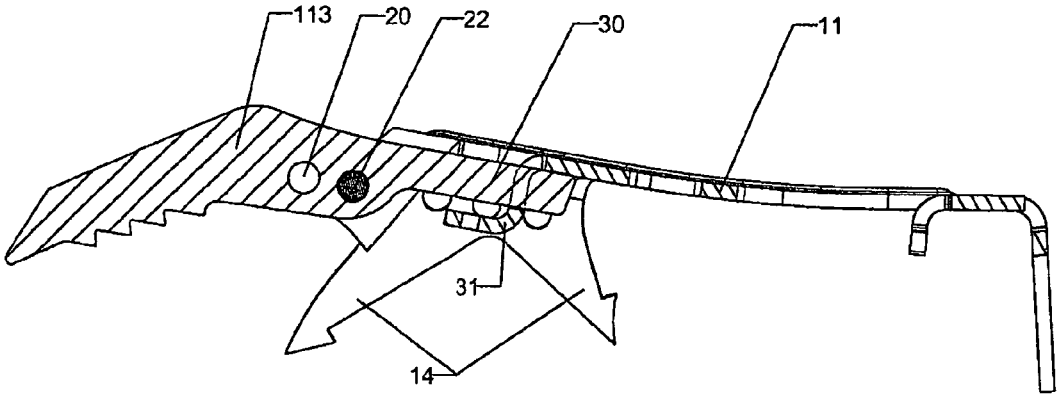
FIGS. 13A and 13B are longitudinal cross-sectional views of FIG. 12 respectively in the advanced and withdrawn positions.
Figure 13B:
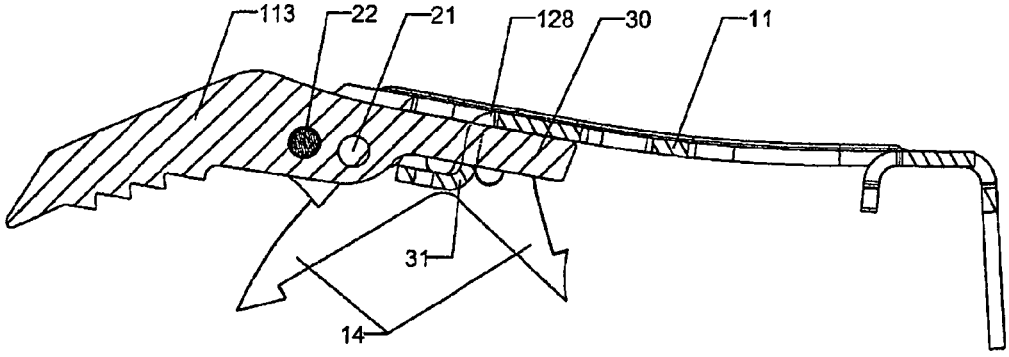
Figure 14:
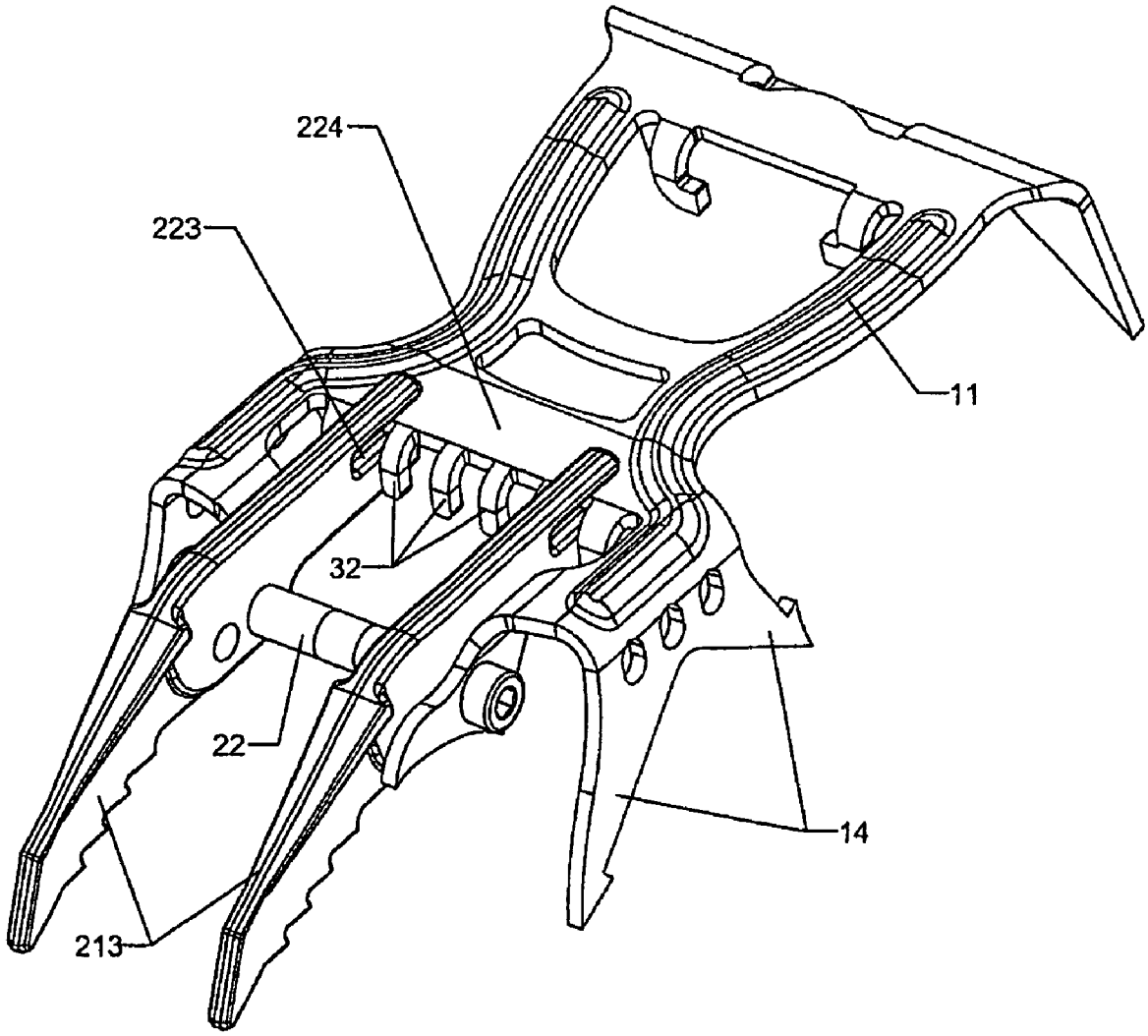
FIGS. 14 and 15 are identical views to FIG. 11 of another alternative embodiment respectively in the advanced and withdrawn positions.
Figure 15:
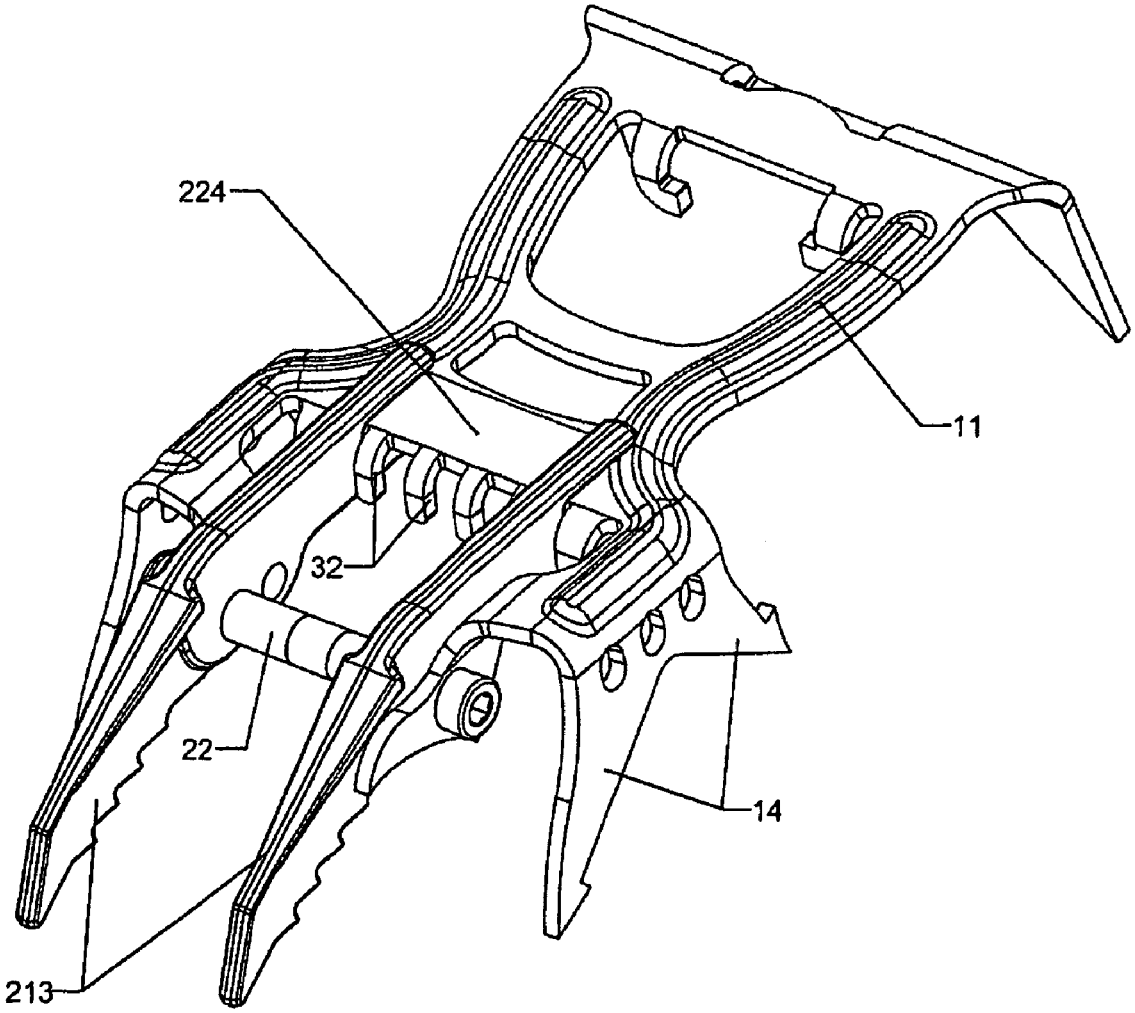
Figure 16A:
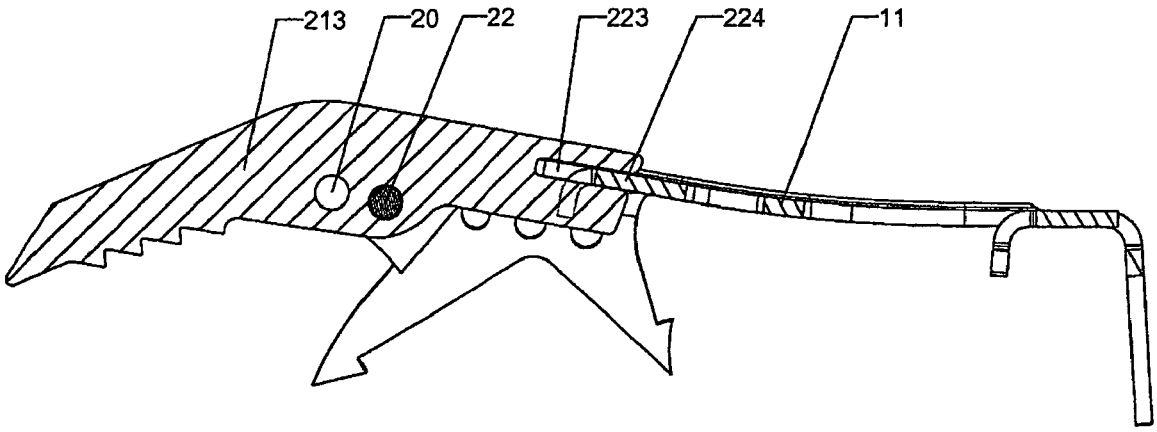
FIGS. 16A and 16B are longitudinal cross-sectional views of FIGS. 14 and 15.
Figure 16B:
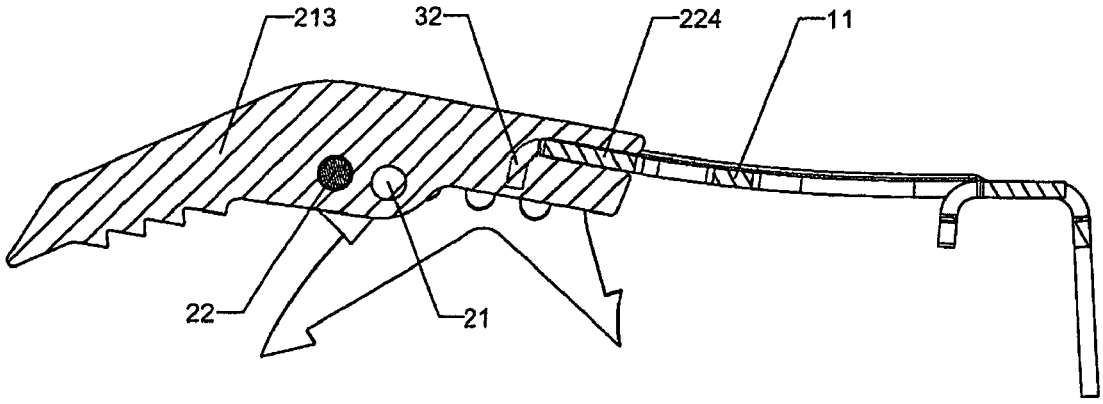

In FIGS. 9 and 10, the two front spikes 13 are housed in indentations 28 that are the closest to cross-member 24, being separated from one another by a minimum gap d3. In FIG. 9, both of the front spikes 13 are simultaneously located in the withdrawn position whereas they are in the advanced position in FIG. 10.

In all the longitudinal and lateral positions represented in the foregoing figures, the same fixing screw 22 passes through one of apertures 20 or 21 and, together with the sliding link, performs efficient securing of single-blade or two-blade front spikes 13.

With reference to the alternative embodiment of FIGS. 11 to 13B, the rear tail 30 of each front spike 113 is straight and is housed sliding in one of indentations 128 arranged transversely in a wing 31 folded down towards the bottom of cross-member 124. The shape of indentations 128 enables lateral and longitudinal positioning of front spikes 113 to be ensured.

In the other alternative embodiment of FIGS. 14 to 16B, lateral positioning cross-member 224 comprises a series of downwardly-curved claws 32. A groove 223 opens out at the end of each front spike 213 and straddles cross-member 224 in the gap between two adjacent claws 32.

The invention claimed is:

1. An ice crampon including a metal armature, the metal armature comprising:

a horizontal support plate equipped with vertical anchoring spikes, at least one front spike in the form of a blade salient from the front part of the armature, and an adjustment device for adjusting longitudinally said front spike between a first back position and a second advanced position, said adjustment device including:

two apertures arranged in the intermediate part of said front spike for allowing passage of a single fixing screw in each of said first back position, and said second advanced position, and a sliding link formed by a semi-open groove arranged in the rear part of the front spike, said semi-open groove being able to slide longitudinally on a positioning cross-member so as to slide a distance corresponding to a longitudinal distance between the two apertures, said positioning cross-member securely attached to the metal armature.

2. The ice crampon according to claim 1, wherein the positioning cross-member is notched over its whole width with a succession of rectangular notches and indentations arranged symmetrically on the two opposite sides.

3. The ice crampon according to claim 1, wherein the rear groove of the front spike presents a T-shaped profile with a straight bottom extending in a direction parallel to the longitudinal offset of the two apertures.

4. The ice crampon according to claim 2, wherein the front spike is arranged in a predefined indentation of the cross-member and is securely blocked in the transverse direction by the adjacent notches in both the withdrawn and advanced positions.

5. The ice crampon according to claim 1, wherein the depth of the groove is slightly larger than the thickness of the cross-member to enable longitudinal adjustment.

6. The ice crampon according to claim 1, wherein the positioning cross-member extends in a direction parallel to the fixing screw enabling one or two front spikes to be fitted with a predefined longitudinal and transversal positioning.

* * * * *